US008312737B2

(12) United States Patent
Bush et al.

(10) Patent No.: US 8,312,737 B2
(45) Date of Patent: Nov. 20, 2012

(54) ECONOMIZER HEAT EXCHANGER

(75) Inventors: James W. Bush, Skaneateles, NY (US); Wayne P. Beagle, Chittenango, NY (US)

(73) Assignee: Carrier Corporation, Farmington, CT (US)

( * ) Notice: Subject to any disclaimer, the term of this patent is extended or adjusted under 35 U.S.C. 154(b) by 587 days.

(21) Appl. No.: 12/521,214

(22) PCT Filed: Dec. 29, 2006

(86) PCT No.: PCT/US2006/062726

§ 371 (c)(1),
(2), (4) Date: Jun. 25, 2009

(87) PCT Pub. No.: WO2008/082408

PCT Pub. Date: Jul. 10, 2008

(65) Prior Publication Data

US 2010/0095700 A1 Apr. 22, 2010

(51) Int. Cl.
*F25B 1/10* (2006.01)

(52) U.S. Cl. ..... 62/510; 62/513

(58) Field of Classification Search ..... 62/513, 62/117, 510, 498; 165/166, DIG. 185; 418/5, 418/7; 29/700
See application file for complete search history.

(56) References Cited

U.S. PATENT DOCUMENTS

| | | | | |
|---|---|---|---|---|
| 2,682,160 | A | 6/1954 | Kromer | |
| 4,232,533 | A * | 11/1980 | Lundblad et al. | 62/509 |
| 5,768,901 | A | 6/1998 | Dormer et al. | |
| 6,058,727 | A * | 5/2000 | Fraser et al. | 62/190 |
| 6,820,434 | B1 | 11/2004 | Gutheim et al. | |
| 6,925,823 | B2 | 8/2005 | Lifson et al. | |
| 6,925,837 | B2 | 8/2005 | Eaton | |
| 7,121,102 | B2 | 10/2006 | Fijas et al. | |
| 2004/0035122 | A1 | 2/2004 | Lifson et al. | |
| 2005/0072175 | A1 * | 4/2005 | Umeo et al. | 62/236 |
| 2006/0090503 | A1 * | 5/2006 | Lifson et al. | 62/510 |

FOREIGN PATENT DOCUMENTS

| | | | |
|---|---|---|---|
| CN | 2740971 | Y | 11/2005 |
| EP | 1669694 | A1 | 6/2006 |
| JP | 6213518 | A | 8/1994 |
| JP | 2005257149 | A | 9/2005 |
| JP | 2006524313 | A | 10/2006 |
| WO | 2007111586 | A1 | 10/2007 |

OTHER PUBLICATIONS

Japanese Office Action for JP Patent Application No. 2009-543996, dated Jan. 10, 2012.
Chinese Office Action for CN Patent Application No. 200680056851.1, dated Jun. 23, 2010.
EP Search Report for EP Patent Application No. 06846865, dated Jul. 12, 2012.

* cited by examiner

*Primary Examiner* — Mohammad Ali
(74) *Attorney, Agent, or Firm* — Bachman & LaPointe, P.C.

(57) ABSTRACT

A refrigeration system includes a compressor. A heat rejection heat exchanger is downstream of the compressor along a refrigerant primary flowpath. An expansion device is downstream of the heat rejection heat exchanger along the primary flowpath. A heat absorption heat exchanger is downstream of the expansion device along the primary flowpath. An economizer heat exchanger is between the heat rejection heat exchanger and the expansion device along the primary flowpath. The economizer heat exchanger includes a first portion configured to provide heat transfer from the primary flowpath to a first economizer flowpath. The economizer heat exchanger includes a second portion configured to provide heat transfer from the primary flowpath to a second economizer flowpath.

18 Claims, 5 Drawing Sheets

ECONOMIZER HEAT EXCHANGER

BACKGROUND OF THE INVENTION

The invention relates to refrigeration. More particularly, the invention relates to economizer heat exchangers in a transport refrigeration system.

As a natural and environmentally benign refrigerant, $CO_2$ (R-744) is attracting significant attention as a refrigerant. Potential applications include transport refrigeration units (e.g., truck boxes, trailers, cargo containers, and the like) which require broad capabilities. A given unit configuration may be made manufactured for multiple operators with different needs. Many operators will have the need to, at different times, use a given unit for transport of frozen goods and non-frozen perishables. An exemplary frozen goods temperature is about −10° F. or less and an exemplary non-frozen perishable temperature is 34-38° F. The operator will predetermine appropriate temperature for each of the two modes. Prior to a trip or series, the technician or driver will enter the appropriate one of the two temperatures. Other operators may have broader requirements (e.g., an exemplary overall range of −40-57° F.).

In the HVAC art, use of economizer heat exchangers (economizers) is well known.

SUMMARY OF THE INVENTION

One aspect of the disclosure involves a refrigeration system. The system includes a compressor. A heat rejection heat exchanger is downstream of the compressor along a refrigerant primary flowpath. An expansion device is downstream of the heat rejection heat exchanger along the primary flowpath. A heat absorption heat exchanger is downstream of the expansion device along the primary flowpath. An economizer heat exchanger is between the heat rejection heat exchanger and the expansion device along the primary flowpath. The economizer heat exchanger includes a first portion configured to provide heat transfer from the primary flowpath to a first economizer flowpath. The economizer heat exchanger includes a second portion configured to provide heat transfer from the primary flowpath to a second economizer flowpath.

In various implementations, the compressor may have first, second, and third cylinders. The first economizer flowpath may branch from the primary flowpath between the economizer heat exchanger and the expansion device and return to the primary flowpath between the first and second cylinders. The second economizer flowpath may branch from the primary flowpath between the economizer heat exchanger and the expansion device and return to the primary flowpath between the second cylinder and the heat rejection heat exchanger. The first economizer flowpath may extend through a second expansion device and the economizer first portion. The second economizer flowpath may extend through a third expansion device, the economizer second portion, and the third cylinder. A charge of the refrigerant may comprise at least 50%, by weight, carbon dioxide.

The economizer may comprise a single stack of heat exchanger plates defining a plurality of alternating first spaces and second spaces. The first spaces may provide a series of parallel legs of the primary flowpath. A first group of the second spaces may provide a series of parallel legs of the first economizer flowpath. A second group of the second spaces may provide a series of parallel legs of the second economizer flowpath. The economizer may comprise a single housing having an interior along the primary flowpath. A first conduit may extend through the housing along the first economizer flowpath. A second conduit may extend through the housing along the second economizer flowpath. The economizer may comprise a first coil along the primary flowpath and second and third coils respectively along the first economizer flowpath and second economizer flowpath and respectively overwrapping first and second portions of the first coil.

The system may be engineered as a reengineering of a baseline system having separate first and second economizer heat exchangers.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
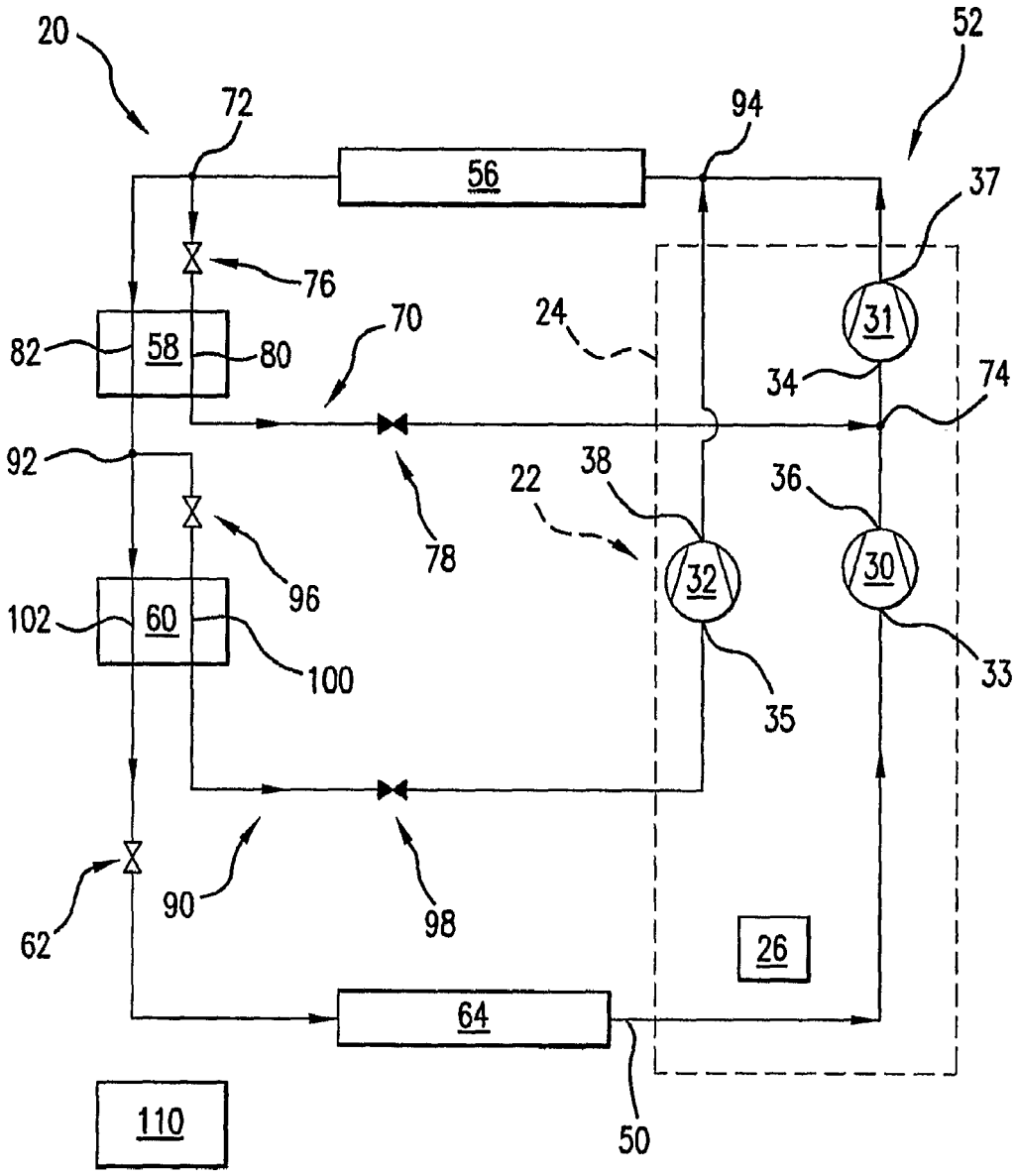
FIG. 1 is a schematic view of a baseline refrigeration system.

FIG. 1 shows an exemplary refrigeration system 20 including a compressor 22. The compressor has a housing assembly 24. The exemplary compressor includes an electric motor 26. An exemplary compressor is a reciprocating compressor wherein the housing defines a plurality of cylinders. Each cylinder accommodates an associated piston. Exemplary multi-cylinder configurations include: in-line; vee; and horizontally opposed. The exemplary compressor includes three cylinders 30, 31, and 32. Each of the cylinders includes a suction location (e.g., a suction port at a suction plenum) 33; 34; 35. Each compressor similarly includes a discharge location 36; 37; 38. In the exemplary system, the first cylinder compression location 36 is coupled to the second cylinder suction location 34 (e.g., as a shared plenum). Exemplary refrigerant is $CO_2$-based.

The system 20 includes a system suction location/condition 50. In the exemplary system, this is at the suction location/condition 33 of the first cylinder. A refrigerant primary flowpath 52 proceeds downstream from the suction location/condition 50 through the first cylinder 30 and then through the second cylinder 31 in series. The primary flowpath 52 proceeds downstream through the inlet of a first heat exchanger (gas cooler/condenser) 56 to exit the outlet of the gas cooler/condenser. The primary flowpath 52 proceeds downstream similarly through a first economizer heat exchanger (economizer) 58. The primary flowpath then proceeds downstream through a second economizer heat exchanger 60. The primary flowpath 52 then proceeds downstream through an expansion device 62. The primary flowpath 52 then proceeds downstream through a second heat exchanger (evaporator) 64 to return to the suction condition/location 50.

In a normal operating condition, a recirculating flow of refrigerant passes along the primary flowpath 52, being compressed in the first and second cylinders 30 and 31. The compressed refrigerant is cooled in the gas cooler/condenser 56, expanded in the first expansion device 62, and then heated in the evaporator 64. In an exemplary implementation, the gas cooler/condenser 56 and evaporator 64 are refrigerant-air heat exchangers with associated fan-forced air flows. The evaporator 64 may be in the refrigerated space or its airflow may pass through the refrigerated space. Similarly, the gas cooler/condenser 56 or its airflow may be external to the refrigerated space.

The exemplary system 20 includes a first economizer flowpath 70. The first economizer flowpath 70 branches from the primary flowpath at a location/condition 72 between the gas cooler/condenser outlet and first economizer inlet. The exemplary first economizer flowpath 70 returns to the primary refrigerant flowpath at a location/condition 74 between the first and second cylinders (e.g., at their respective outlet/discharge and inlet/suction conditions/locations). The first economizer flowpath 70 passes sequentially through a second expansion device 76, then the first economizer 58, and then a valve 78. A leg 80 of the first economizer flowpath 70 in the first economizer 58 is in heat transfer relation with a leg 82 of the primary flowpath 52 within the first economizer 58.

The exemplary system 20 also includes a second economizer flowpath 90. The second economizer flowpath 90 branches from the primary flowpath 52 at a condition/location 92 between the first and second economizers. The second economizer flowpath 90 returns to the primary flowpath 52 at a condition/location 94 between the second cylinder 31 and the gas cooler/condenser 56. The second economizer flowpath 90 proceeds sequentially through a third expansion device 96, the second economizer 60, a valve 98, and the cylinder 32. A leg 100 of the second economizer flowpath 90 in the second economizer 60 is in heat transfer relation with a leg 102 of the primary flowpath 52 within the economizer 60.

Additional system components and further system variations are possible.

The exemplary expansion devices 62, 76, and 96 may be fixed expansion devices, thermomechanically controlled expansion devices, or system-controlled expansion devices. For example, in various implementations, the first expansion device 62 may be an electronic expansion valve controlled by a control system 110 which may also control operation of the compressor, other valves, fans, and the like. The expansion devices 96 and 76 may be similar or may be fixed orifices. Alternatively, the devices may be thermal expansion valves with control bulbs appropriately mounted in the system. Exemplary valves 78 and 98 may be simple on-off valves, electronically controlled by the control system 110.

In operation, the first economizer flowpath 70 may be operated by the valve 78 to run the first economizer 58 as is well known in the art. Similarly, the valve 98 may be used to provide further economizer function.

Figure 2:
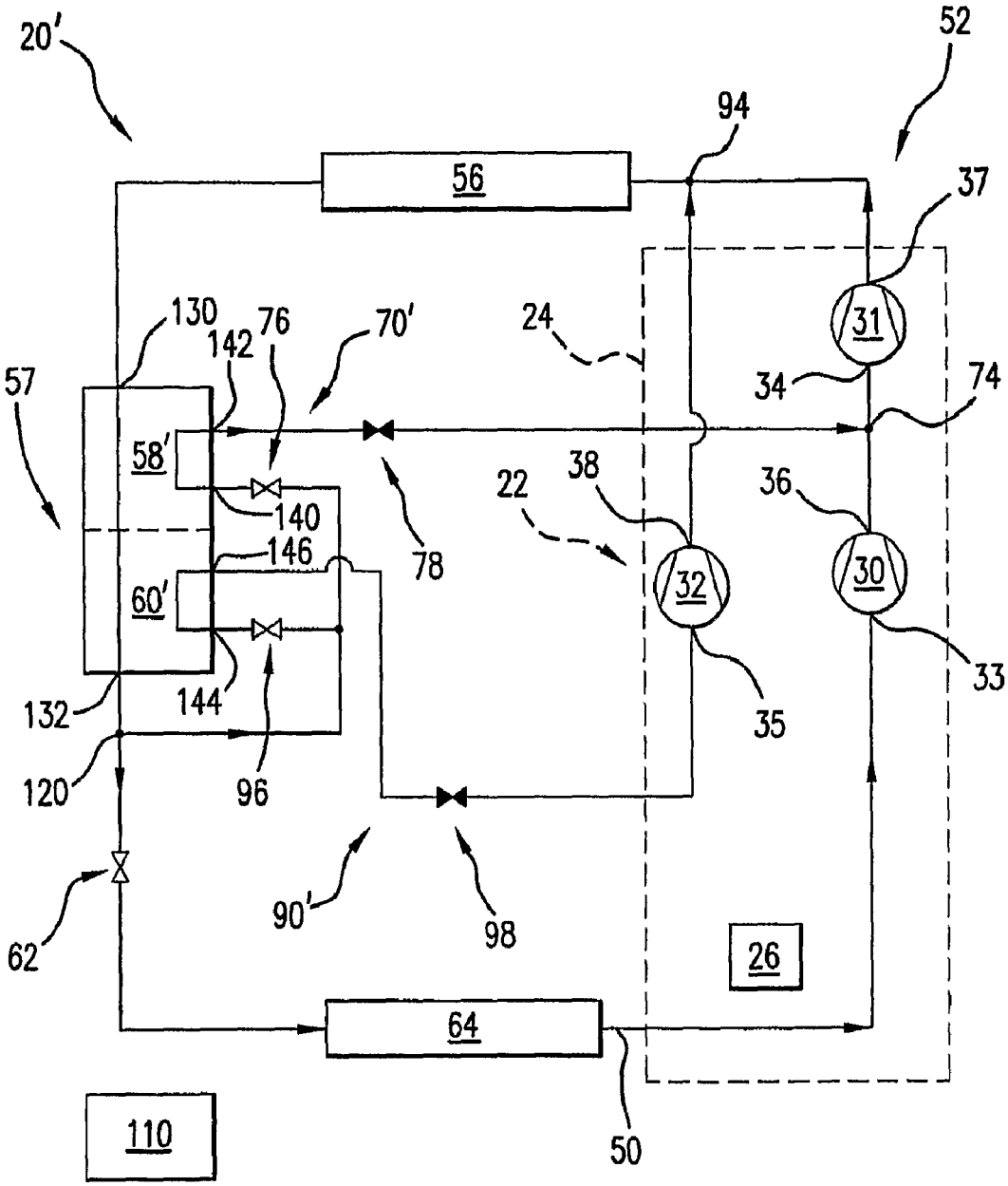
FIG. 2 is a schematic view of a revised system.

The provision of multiple economizer heat exchangers may bring manufacturing cost and packaging space problems. Accordingly, the two heat exchangers may advantageously be combined to save cost and/or space. FIG. 2 shows a system 20' revised from the baseline system 20 of FIG. 1. A composite heat exchanger 57 includes portions 58' and 60' in lieu of the separate heat exchangers 58 and 60. In the FIG. 2 example, the economizer flowpaths 70' and 90' replace the flowpaths 70 and 90. These flowpaths 70' and 90' initially branch in parallel from a location 120 between the heat exchanger 57 and expansion device 62. The exemplary heat exchanger 57 thus has a warm refrigerant inlet 130 and a warm refrigerant outlet 132 along the primary flowpath 52. The heat exchanger 57 includes cold refrigerant inlet 140 and cold refrigerant outlet 142 along the flowpath 70'. The heat exchanger 57 similarly includes a cold refrigerant inlet 144 and a cold refrigerant outlet 146 along the flowpath 90'.

Figure 3:
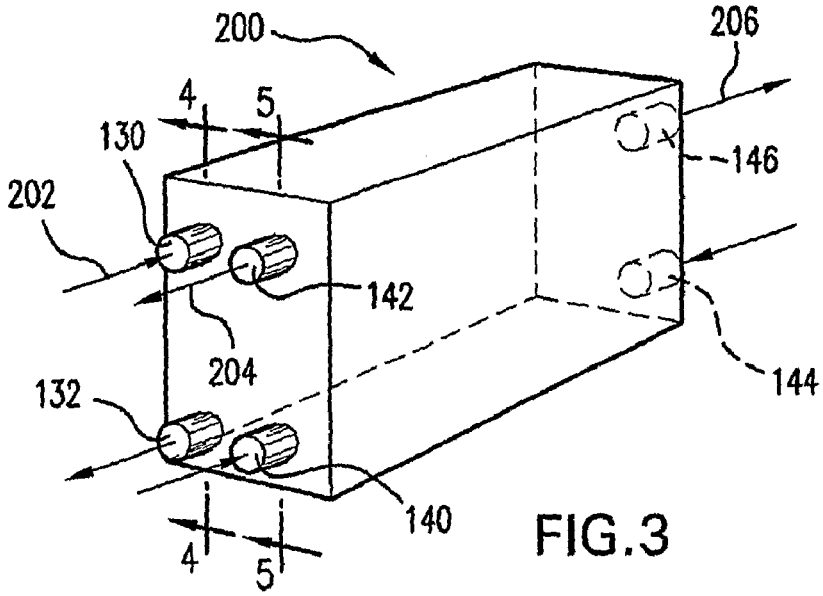
FIG. 3 is a view of a first heat exchanger for the revised system of FIG. 2.
Figure 4:
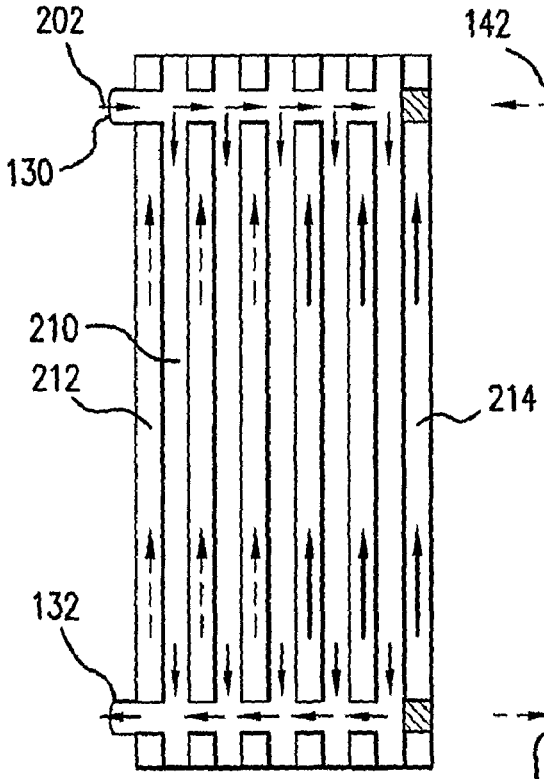
FIG. 4 is a sectional view of the heat exchanger of FIG. 3, taken along line 4-4.
Figure 5:
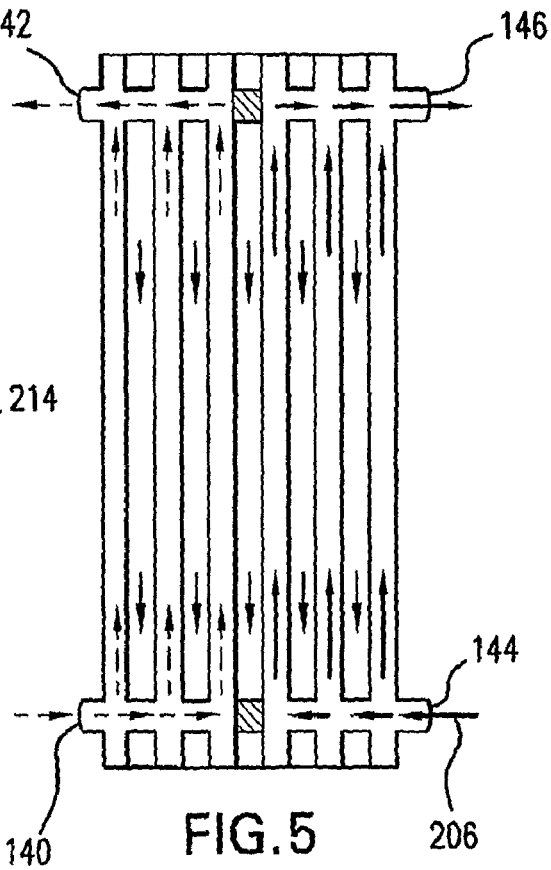
FIG. 5 is a sectional view of the heat exchanger of FIG. 3, taken along line 5-5.

FIGS. 3-5 schematically show a brazed plate heat exchanger 200 which may be used as the heat exchanger 57. Accordingly, similar numbers are used to identify the inlets and outlets (ports). A warm refrigerant flow 202 enters the warm refrigerant inlet 130 and exits the warm refrigerant outlet 132. The refrigerant flow 204 of the economizer flowpath 70' enters the inlet 140 and exits the outlet 142. Similarly, the refrigerant flow 206 of the economizer flowpath 90' enters the inlet 144 and exits the outlet 146. The brazed plate heat exchanger has alternating groups of first and second spaces defined between plates of a plate stack. The first spaces 210 pass the flow 202 (e.g., in a series of parallel legs). A first group of the second spaces 212 pass the flow 204. A second group of the second spaces 214 pass the flow 206.

Figure 6:
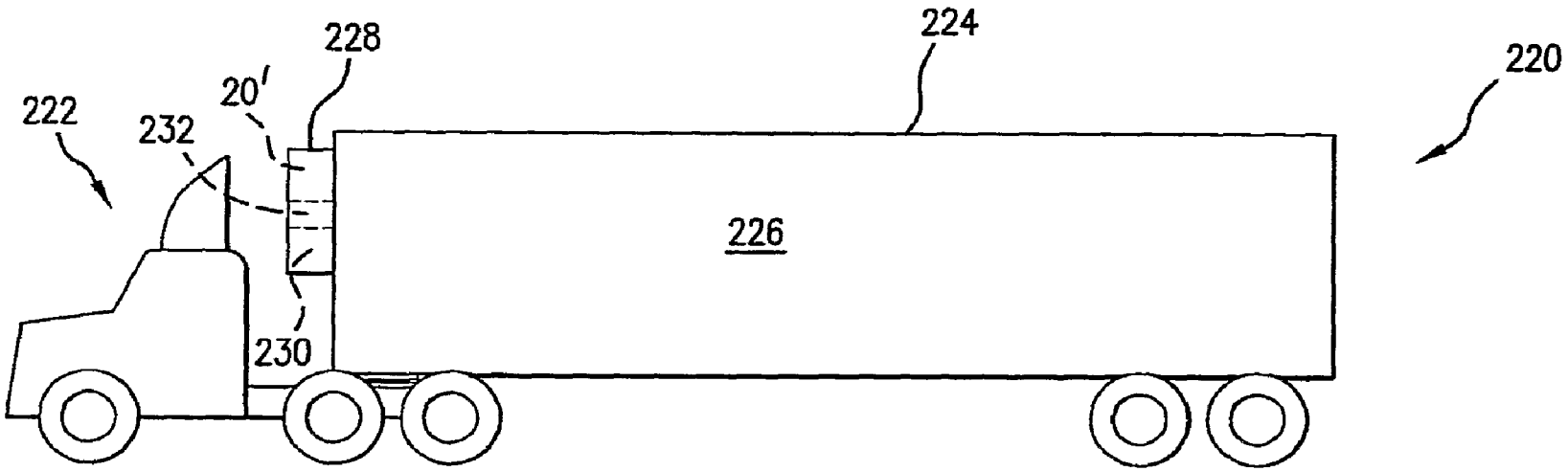
FIG. 6 is a view of a refrigerated transport unit.

FIG. 6 shows a refrigerated transport unit (system) 220 in the form of a refrigerated trailer. The trailer may be pulled by a tractor 222. The exemplary trailer includes a container/box 224 defining an interior/compartment 226. An equipment housing 228 mounted to a front of the box 224 may contain an electric generator system including an engine 230 (e.g., diesel) and an electric generator 232 mechanically coupled to the engine to be driven thereby. The refrigeration system 20' may be electrically coupled to the generator 232 to receive electrical power. The evaporator and its associated fan may be positioned in or otherwise in thermal communication with the compartment 226.

Figure 7:
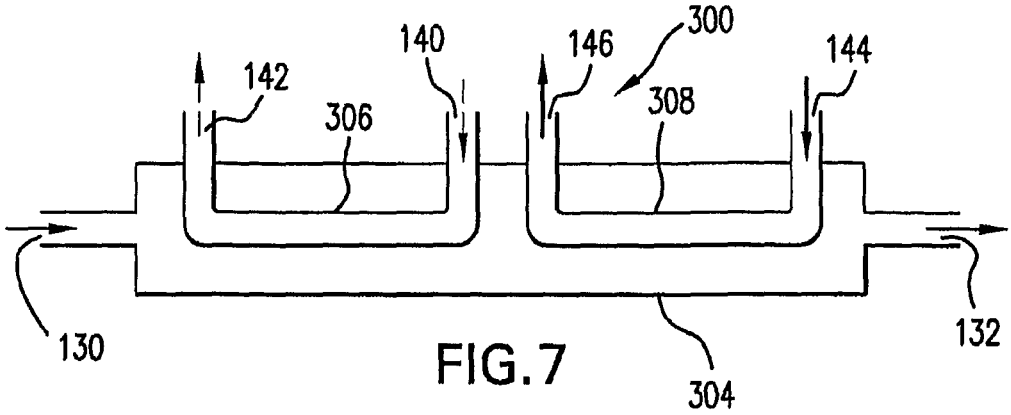
FIG. 7 is a cutaway view of a second heat exchanger.

FIG. 7 shows a tube-in-tube heat exchanger 300. A main tube 304 passes the warm refrigerant flow and defines a main housing of the heat exchanger 300. Along the economizer flowpath 70' and 90', respective tubes 306 and 308 extend into and through the main tube 304.

Figure 8:
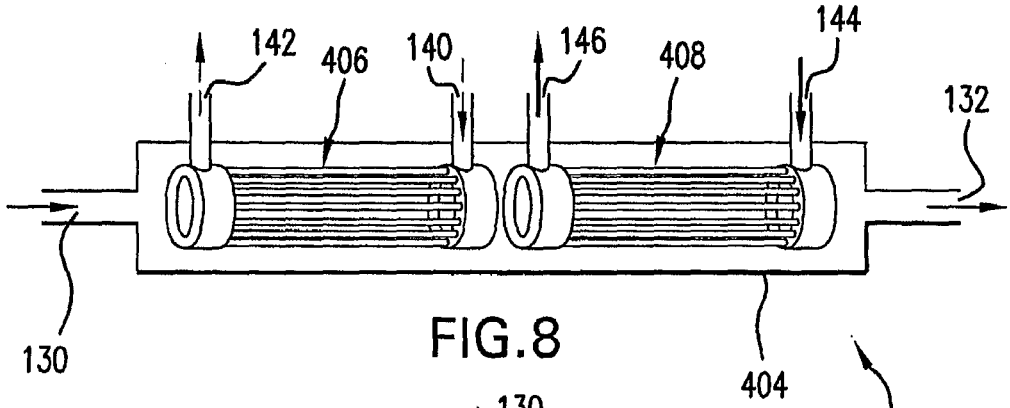
FIG. 8 is a cutaway view of a third heat exchanger.

FIG. 8 shows a shell-and-tube heat exchanger 400. The heat exchanger 400 has a shell/housing 404 passing the warm refrigerant flow and containing manifold tube arrays 406 and 408 passing the economizer flows.

Figure 9:
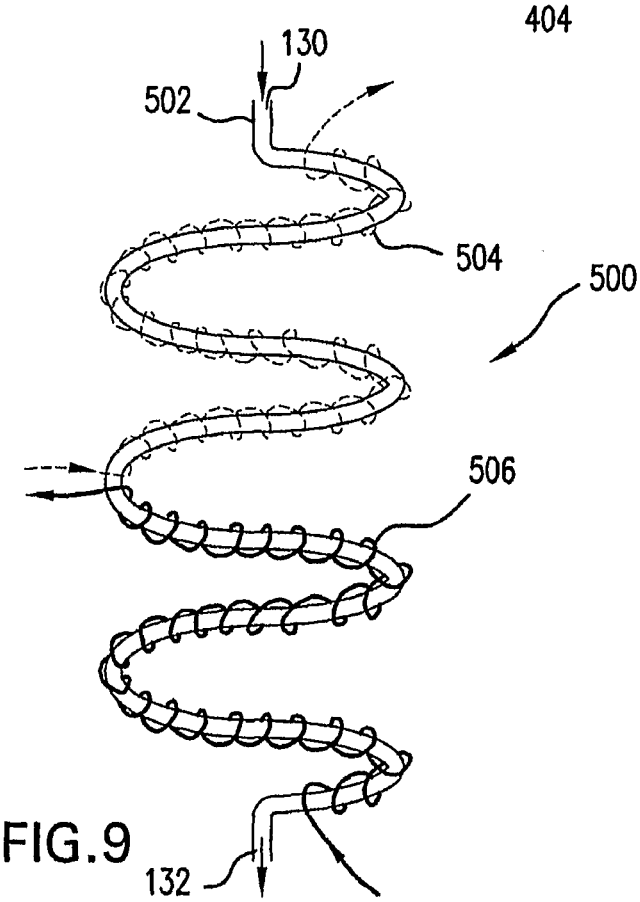
FIG. 9 is a view of a fourth heat exchanger.

FIG. 9 shows a tube-on-tube or coil-on-tube heat exchanger 500. A main tube 502 passes the warm refrigerant flow whereas first and second tubes 504 and 506 pass the tube economizer flows. To this extent, the heat exchanger 500 is regarded as a single unit because the structure of the tube 502 is a continuous convolution across its engagement with the two other tubes rather than being discontinuous.

In engineering the system, the relative sizes of the two portions of the combined economizer may be selected for a variety of purposes. For example, they may be sized in view of or along with other components to optimize efficiency, capacity, and the like. For example, an exemplary reengineering preserves the compressor, heat absorption heat exchanger, and heat rejection heat exchanger of a baseline system having one economizer (a single path economizer) or two separate economizers. A computer simulation and/or hardware experiments may determine optimal relative and absolute sizes of the two portions 58' and 60' to maximize system efficiency. The two portions may thus differ in size or other properties. For the brazed plate exchanger, this may involve different quantities of plates in each section if similar plates are used in both sections.

The operation of the valves 78 and 98 depend on the controlled and ambient conditions and on the modes of operation. In an exemplary embodiment, the valves 76 and 96 directly regulate flow based on a sensed parameter of the cycle. The valves 78 and 98 regulate the economization of the cycle under control of the controller. If either of valves 78 and 98 are open they improve the efficiency and capacity of the system. In an exemplary implementation, the valves 78 and 98 may be kept closed during system startup to prevent overloading of the compressor. The valves 78 and 98 may also be kept closed when a low capacity is required (e.g., a relatively high desired temperature of the cooled space such as in a non-frozen perishable cargo mode).

Only one of the valves 78 and 98 might be opened in an intermediate state (e.g., where having both open might result in current overdraw or other problem). Subtle optimization considerations may differentiate between the choice of that valve. The system may, however be configured via selection of economizer heat exchanger size and cylinder/chamber size to increase the differentiation between the use of the two economizer sections and their associated situations. Selection between the two may be made by the controller responsive to a combination pf pre-programming, user-set parameters, sensed parameters, and/or calculated parameters (e.g., current draws). Other factors that may influence the particular combination include compressor balance or vibration control.

One or more embodiments of the present invention have been described. Nevertheless, it will be understood that various modifications may be made without departing from the spirit and scope of the invention. For example, when implemented in the reengineering of an existing compressor configuration or remanufacturing of an existing system, details of the baseline configuration may influence or dictate details of any particular implementation. Accordingly, other embodiments are within the scope of the following claims.

What is claimed is:

1. A refrigeration system comprising:
- a compressor;
- a heat rejection heat exchanger downstream of the compressor along a refrigerant primary flowpath;
- an expansion device downstream of the heat rejection heat exchanger along the refrigerant primary flowpath; and
- a heat absorption heat exchanger downstream of the expansion device along the refrigerant primary flowpath; and
- a single economizer heat exchanger unit between the heat rejection heat exchanger and the expansion device along the refrigerant primary flowpath and comprising:
  - a first portion configured to provide heat transfer from the primary flowpath to a first economizer flowpath; and
  - a second portion configured to provide heat transfer from the primary flowpath to a second economizer flowpath, wherein:
- the compressor has a first cylinder, a second cylinder, and a third cylinder;
- the first economizer flowpath branches from the primary flowpath between the economizer heat exchanger and the expansion device and returns to the primary flowpath between the first and second cylinders and extends through:
  - a second expansion device; and
  - the economizer first portion; and
- the second economizer flowpath branches from the primary flowpath between the economizer heat exchanger and the expansion device and returns to the primary flowpath between the second cylinder and the heat rejection heat exchanger and extends through:
  - a third expansion device;
  - the economizer second portion; and
  - the third cylinder.

2. The system of claim 1 wherein the economizer comprises:
- a single stack of heat exchanger plates defining a plurality of alternating first spaces and second spaces, the first spaces providing a series of parallel legs of the primary flowpath, a first group of the second spaces providing a series of parallel legs of the first economizer flowpath, and a second group of the second spaces providing a series of parallel legs of the second economizer flowpath.

3. The system of claim 2 wherein:
- the plates are brazed to each other.

4. The system of claim 1 wherein the economizer comprises:
- a single housing having an interior along the primary flowpath;
- a first conduit extending through the housing along the first economizer flowpath; and
- a second conduit extending through the housing along the second economizer flowpath.

5. A refrigeration system comprising:
- a compressor;
- a heat rejection heat exchanger downstream of the compressor along a refrigerant primary flowpath;
- an expansion device downstream of the heat rejection heat exchanger along the refrigerant primary flowpath; and
- a heat absorption heat exchanger downstream of the expansion device along the refrigerant primary flowpath; and
- an economizer heat exchanger between the heat rejection heat exchanger and the expansion device along the refrigerant primary flowpath and comprising:
  - a first portion configured to provide heat transfer from the primary flowpath to a first economizer flowpath; and
  - a second portion configured to provide heat transfer from the primary flowpath to a second economizer flowpath wherein the economizer comprises:
- a first coil along the primary flowpath;
- a second coil along the first economizer flowpath and overwrapping a first portion of the first coil; and
- a third coil along the second economizer flowpath and overwrapping a second portion of the first coil.

6. The system of claim 5 further comprising:
- a transport container having a compartment positioned in thermal communication with the heat absorption heat exchanger.

7. The system of claim 6 further comprising:
- an internal combustion engine-powered generator coupled to the compressor to power the compressor.

8. The system of claim 7 wherein:
- a refrigerant charge of the system is at least 50% carbon dioxide by weight.

9. The system of claim 5 wherein:
- a refrigerant charge of the system is at least 50% carbon dioxide by weight.

10. A refrigeration system comprising:
- a compressor;
- a heat rejection heat exchanger downstream of the compressor along a refrigerant primary flowpath;
- an expansion device downstream of the heat rejection heat exchanger along the refrigerant primary flowpath; and
- a heat absorption heat exchanger downstream of the expansion device along the refrigerant primary flowpath; and a single brazed plate economizer heat exchanger between the heat rejection heat exchanger and the expansion device along the refrigerant primary flowpath and comprising:

a first portion configured to provide heat transfer from the primary flowpath to a first economizer flowpath; and a second portion configured to provide heat transfer from the primary flowpath to a second economizer flowpath, wherein:

the first economizer flowpath branches from the primary flowpath between the economizer heat exchanger and the expansion device and returns to the primary flowpath and extends through:

a second expansion device; and the economizer first portion; and the second economizer flowpath branches from the primary flowpath between the economizer heat exchanger and the expansion device and returns to the primary flowpath and extends through:

a third expansion device; and the economizer second portion.

11. A method for reengineering a refrigeration system configuration from a baseline configuration to a revised configuration, the revised configuration being a system according to claim 10, the method comprising:

determining different relative sizes of the first portion and the second portion to optimize at least one operational parameter of the system.

12. The method of claim 11 wherein the determining comprises determining relative numbers of plates of said single brazed plate heat exchanger as said economizer heat exchanger.

13. The method of claim 11 wherein the baseline configuration includes separate heat exchangers which are replaced by said single brazed plate economizer heat exchanger in the revised configuration.

14. The method of claim 11 wherein the baseline configuration includes separate heat exchangers which are replaced by a single heat exchanger of the revised configuration as said economizer heat exchanger.

15. The system of claim 10 further comprising:

a transport container having a compartment positioned in thermal communication with the heat absorption heat exchanger.

16. The system of claim 15 wherein a refrigerant charge comprises at least 50%, by weight, carbon dioxide.

17. The system of claim 10 wherein:

the first economizer flowpath returns to an interstage between a first cylinder of the compressor and a second cylinder of the compressor; and the second economizer flowpath returns to an inlet of a third cylinder of the compressor; and the second cylinder and the third cylinder discharge in parallel to an inlet of the heat rejection heat exchanger.

18. The system of claim 10 wherein a refrigerant charge comprises at least 50%, by weight, carbon dioxide.

* * * * *